US006494259B2

(12) United States Patent
Surjaatmadja

(10) Patent No.: US 6,494,259 B2
(45) Date of Patent: Dec. 17, 2002

(54) DOWNHOLE FLAME SPRAY WELDING TOOL SYSTEM AND METHOD

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/822,044

(22) Filed: Mar. 30, 2001

(65) Prior Publication Data

US 2002/0139528 A1 Oct. 3, 2002

(51) Int. Cl.[7] ..... E21B 29/00

(52) U.S. Cl. ..... 166/277; 166/380; 166/115; 166/242.6

(58) Field of Search ..... 166/244.1, 277, 166/380, 115, 242.1, 242.6

(56) References Cited

U.S. PATENT DOCUMENTS 2,990,653 A * 7/1961 Browning
4,239,838 A * 12/1980 Miller et al.
4,370,538 A * 1/1983 Browning
4,386,737 A * 6/1983 Antonov et al.
4,416,421 A * 11/1983 Browning
4,699,210 A * 10/1987 Brannstrom
4,708,913 A * 11/1987 Baldi
5,005,764 A * 4/1991 Simm et al.
5,195,588 A * 3/1993 Dave
5,755,299 A 5/1998 Langford, Jr. et al. ..... 175/375
6,065,209 A 5/2000 Goudouin ..... 29/890.14
6,116,356 A 9/2000 Doster et al. ..... 175/75
6,117,493 A 9/2000 North ..... 427/419.7
6,138,779 A 10/2000 Boyce ..... 175/374

* cited by examiner

*Primary Examiner*—Roger Schoeppel
(74) *Attorney, Agent, or Firm*—John W. Wustenberg; Neal R. Kennedy; Robert A. Kent

(57) ABSTRACT

A downhole apparatus and method for depositing metal at a desired area in a well casing. In one embodiment the apparatus comprises an oxygen tank filled with oxygen, a fuel tank filled with fuel, and a metal depositing device. An inert gas, such as nitrogen, may be supplied to dampen the heat generated by the metal depositing device. In an alternate embodiment, the apparatus comprises a gas tank with nitrous oxide therein and a sparking device to initiate a decomposition reaction to separate the nitrous oxide into its oxygen and nitrogen components. The metal depositing device may be adapted for flame spraying, plasma spraying or welding. A steering head is provided to reciprocate and rotate the apparatus so that the metal depositing device may be directed to the desired area in the casing. A camera and light are disposed at the bottom of the apparatus so that the interior of a well casing is illuminated and an image is transmitted to the operator for proper actuation of the steering sub. Details of a flame spraying method are disclosed.

67 Claims, 3 Drawing Sheets

DOWNHOLE FLAME SPRAY WELDING TOOL SYSTEM AND METHOD

BACKGROUND OF THE INVENTION

1. Field of the Invention

This invention relates to the repair and connection of downhole casing in a wellbore, and more particularly, to a tool system and method for repairing damaged areas, closing gaps between casing sections and filling other openings in well casing by flame spraying, plasma spraying, welding and other similar methods.

2. Description of the Prior Art

When well casing is installed in a wellbore, there may be gaps formed between casing joints. This is a particular problem, for example, between a lateral casing and the wall to which it is welded. Such gaps can be from several inches to as much as twenty feet or more. Closing this gap is a very difficult and time-consuming operation. This is also true in repairing a large damaged area or filling other openings in casing.

Filling such gaps or damaged areas using wire feeder type welding apparatus, either electric or laser type welders, may in fact prove to be impossible. In such cases, the problems associated with such openings may require different operations in the well, and in extreme cases may mean abandonment of that particular wellbore and the drilling of a new well. Obviously, this is a very undesirable situation, and there is thus a need for equipment and techniques to fill gaps or make repairs quickly and easily within the casing in the wellbore.

The present invention solves this problem by providing an apparatus and method for using techniques such as flame spray or plasma spray technology to do the job. It is estimated with this apparatus that about one-half pound per minute of metal may be deposited to the desired area in the casing, so even large areas can be repaired quickly. Unlike standard above-ground welding techniques, flame spraying or plasma spraying allow the metal to be applied directly to the bare wellbore and not just to the metal of the casing. In this way, the thickness of the deposited layer of metal can be built up as needed and spread out to adjacent casing surfaces. Like welding, the filled area becomes an integral part of the adjacent casing section or sections.

SUMMARY OF THE INVENTION

The present invention provides methods and apparatus for downhole welding to repair downhole casing in a wellbore and/or to close other openings in the casing or between sections of casing. This is accomplished by flame spraying, plasma spraying, welding, or other techniques for applying metallic material.

Thus, the invention may be described as a method of closing an opening in a wellbore casing string comprising the step of filling the opening with metallic material while the casing string is positioned in the wellbore. The opening in the wellbore casing string may be a damaged area of the casing string, a gap formed at adjacent ends of a pair of casing sections, or any other opening in the casing string.

A preferred embodiment of the apparatus comprises an oxygen supply such as a tank, a fuel tank, a metal supply, and metal depositing means in communication with the oxygen tank, fuel tank and metal supply such that heat is generated by the mixture of oxygen and fuel, and heated metal is deposited in the opening of the well casing and adhered thereto.

The fuel tank is filled with a fuel preferably from the group consisting of liquefied petroleum gas, kerosene and acetylene. The liquefied petroleum gas may include, for example, butane or propane.

The apparatus may comprise meters for metering flow of oxygen from the oxygen tank and fuel from the fuel tank. When the fuel is kerosene, the flow of oxygen is preferably less than about 280 standard cubic feet per gallon of kerosene.

The apparatus may additionally comprise a camera and a light disposed adjacent to the camera for lighting an area toward which the camera is directed. The operator may use the camera to guide the spray head to a desired area in the casing. This guiding of the spray head may be carried out by a steering sub adapted for connection to a tool string whereby the spray head may be rotated and reciprocated within the casing so that the spray head may be directed to the desired area in the casing.

In a preferred embodiment, the metal supply is a quantity of metal powder, and the metal depositing means comprises a powder container in which the metal powder is disposed. The metal depositing means further comprises a spray head in communication with the oxygen tank, fuel tank and powder container such that the mixture is a mixture of oxygen, fuel and metal powder which is discharged as a metallized flame spray from the spray head.

In this flame spray embodiment, the apparatus preferably further comprises an inert gas tank in communication with the powder container. The inert gas tank is filled with an inert gas which pushes the metal powder into the spray head. The inert gas is preferably selected from the group consisting of nitrogen and argon. The inert gas is also mixed with the mixture of oxygen, fuel and powder in order to boost flame speed of the flame discharged from the spray head.

In an alternate embodiment, rather than oxygen, a tank may be filled with a gas such as nitrous oxide ($N_2O$) and decomposed into oxygen and nitrogen by adding heat, such as by a sparking device. The decomposition reaction creates additional heat which continues the reaction thus providing oxygen for combustion of the fuel and nitrogen as an inert gas. Additional nitrogen may be added by means of a separate tank, through the casing or a tube from the surface.

One purpose of the inert gas is to keep the combustion temperature controlled so that it does not become excessive. Thus, the heat is dampened to prevent heat damage to the well casing. The inert gas also helps improve vision through a camera by clearing the smoke caused by the combustion.

A tube may be inserted into the well casing adjacent to the tool to evacuate the fumes, thus also aiding and improving vision through the camera.

In still another embodiment, the nitrogen tank may be eliminated and nitrogen pumped down the well annulus to dampen the combustion temperature and clear the smoke.

Stated in another way, the apparatus of the present invention may be described as one for spraying metal into a desired area of a well casing from the inside of the well casing, the apparatus comprising a steering sub adapted for connection to a tool string, a housing attached to the steering sub such that the steering sub may be used to provide movement of the housing with respect to the tool string, an oxygen tank in the housing wherein the oxygen tank has a quantity of pressurized oxygen therein, an inert gas tank in the housing wherein the inert gas tank has a quantity of pressurized inert gas therein, a fuel tank in the housing wherein the fuel tank has a quantity of fuel therein, a powder container in the housing wherein the powder container has a quantity of metal powder therein and is in communication with the inert gas tank such that the pressurized inert gas tends to push the metal powder out of the powder container, and a spray head connected to the housing and in communication with the oxygen tank, fuel tank and powder container such that fuel, oxygen, inert gas and metal powder are mixed in the spray head and discharged therefrom as a flame spray whereby metal may be deposited on the desired area in the casing.

Numerous objects and advantages of the invention will become apparent as the following detailed description of the preferred embodiment is read in conjunction with the drawing which illustrates such embodiment.

DESCRIPTION OF THE PREFERRED EMBODIMENTS

Figure 1:
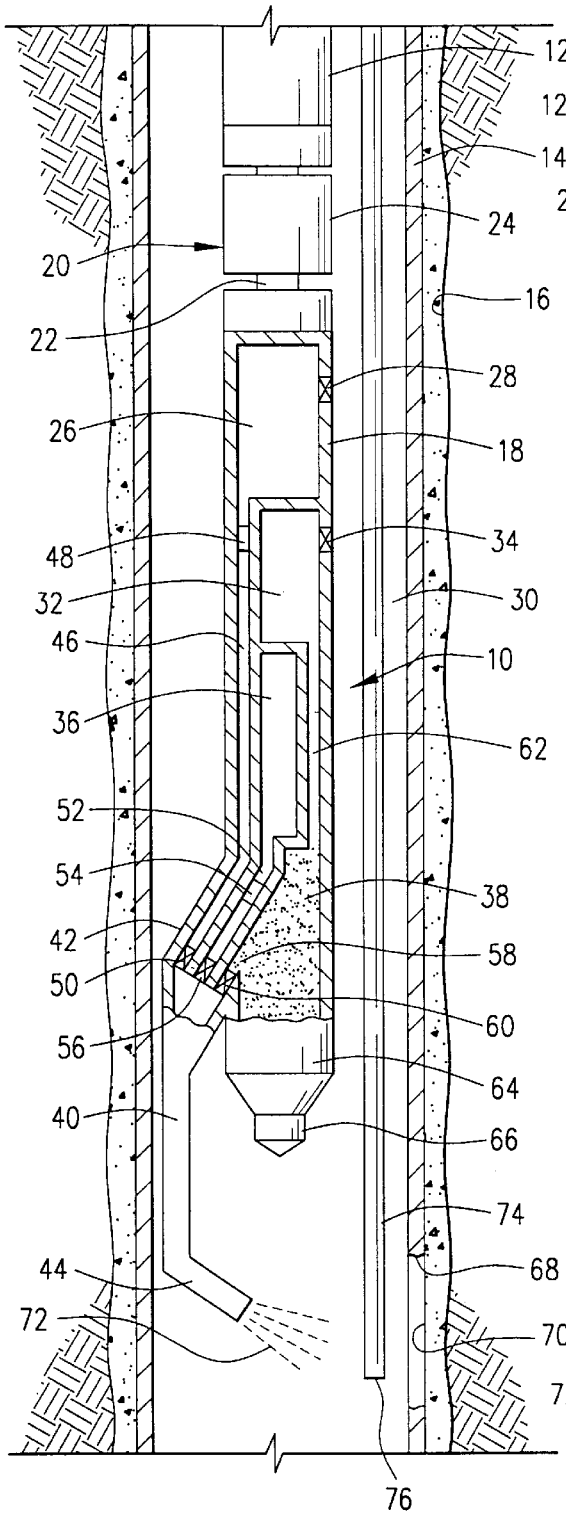
FIG. 1 illustrates a first embodiment of the downhole flame spray welding tool system of the present invention positioned in a well casing.

Referring now to the drawing, a first embodiment of the apparatus of the present invention is shown and generally designated by the numeral 10. First embodiment apparatus 10 is connected to the lower end of a tool string 12 which is positioned in casing 14 of a wellbore 16.

In the drawing, apparatus 10 is illustrated as a flame spray apparatus which is a preferred embodiment. Apparatus 10 comprises a housing 18 which is connected to tool string 12 by a steering sub 20. Steering sub 20 comprises a shaft portion 22 which is actuated by a drive portion 24. Drive portion 24 may be electrically controlled and include means for reciprocating and rotating shaft 22 and thus reciprocating and rotating housing 18.

In the upper portion of housing 18 is an oxygen tank 26 which is filled with a quantity of pressurized oxygen. An oxygen equalizer 28 is disposed in housing 18 to insure that the pressure level in oxygen tank 26 is maintained at a desired level with respect to the pressure within a well annulus 30 defined between apparatus 10 and casing 14, as will be further described herein.

Below oxygen tank 26 is an inert gas tank 32. Inert gas tank 32 is filled with a quantity of pressurized inert gas. The inert gas in inert gas tank 32 may be any desirable gas of this type, such as argon or nitrogen. However, the invention is not intended to be limited to a particular inert gas. An inert gas equalizer 34 is disposed in housing 18 to insure that the pressure of the inert gas in inert gas tank 32 is maintained at a desired level with respect to the pressure in well annulus 30.

A fuel tank 36 is disposed below inert gas tank 32. Fuel tank 36 is filled with any suitable fuel. For example, but not by way of limitation, the fluid may be kerosene, acetylene or a liquefied petroleum gas, such as butane or propane.

A powder container 38 is disposed below fuel tank 36 and is filled with a quantity of metal powder of a kind known in the art. Normally, the metal powder is iron-based, although that is not necessarily the case, and in certain conditions other metals may be used. Basically, any material that will adhere to the well casing as a result of a flame spray process, and is compatible with the fluids being handled in the well, would be suitable.

A spray head 40 extends away from a lower portion of housing 18. Spray head 40 includes a mixing portion 42 and a nozzle portion 44.

An oxygen line 46 interconnects oxygen tank 26 with mixing portion 42 of spray head 40. An oxygen meter 48 may be disposed in oxygen line 46. An oxygen mixing valve 50 is disposed in the lower end of oxygen line 46 within mixing portion 42 of spray head 40.

A fuel line 52 extends from fuel tank 36 to mixing portion 42, and a fuel meter 54 may be disposed in fuel line 52. A fuel mixing valve 56 is disposed in the lower end of fuel line 52 within mixing portion 42 of spray head 40.

A powder opening or line 58 communicates powder container 38 with mixing portion 42 of spray head 40. A powder mixing valve 60 is disposed in powder line 58 within mixing portion 42.

An inert gas line 62 interconnects inert gas tank 32 with powder container 34.

Oxygen meter 48 and fuel meter 54 may be of any kind known in the art. In particular, an electronic flow meter which provides a signal at the surface is preferred, but the invention is not intended to be limited to only that configuration.

Oxygen mixing valve 50, fuel mixing valve 56 and powder mixing valve 60 are also preferably electronically controlled from the surface so that the operator may adjust the amount of oxygen, fuel and metal powder passing therethrough, respectively. The pressurized inert gas in inert gas tank 32 forces the powder in powder container 38 outwardly through powder mixing valve 60 when the powder mixing valve is opened.

At the lower end of housing 18 is a camera 64, of a kind known in the art with a light 66 on the lower end thereof. As will be further described herein, light 66 illuminates the inside of casing 14 so that a desired area 68 is illuminated, and the camera sends an image of area 68 to the operator.

The inert gas is used for a number of reasons. Most importantly, it is used to control the temperature as previously mentioned. It also provides a non-liquid, non-oxygen environment in which the process may take place. The inert gas also provides a media to deliver the powdered metal. Additionally, the inert gas helps displace the smoke for a better view through camera 64.

Figure 3:
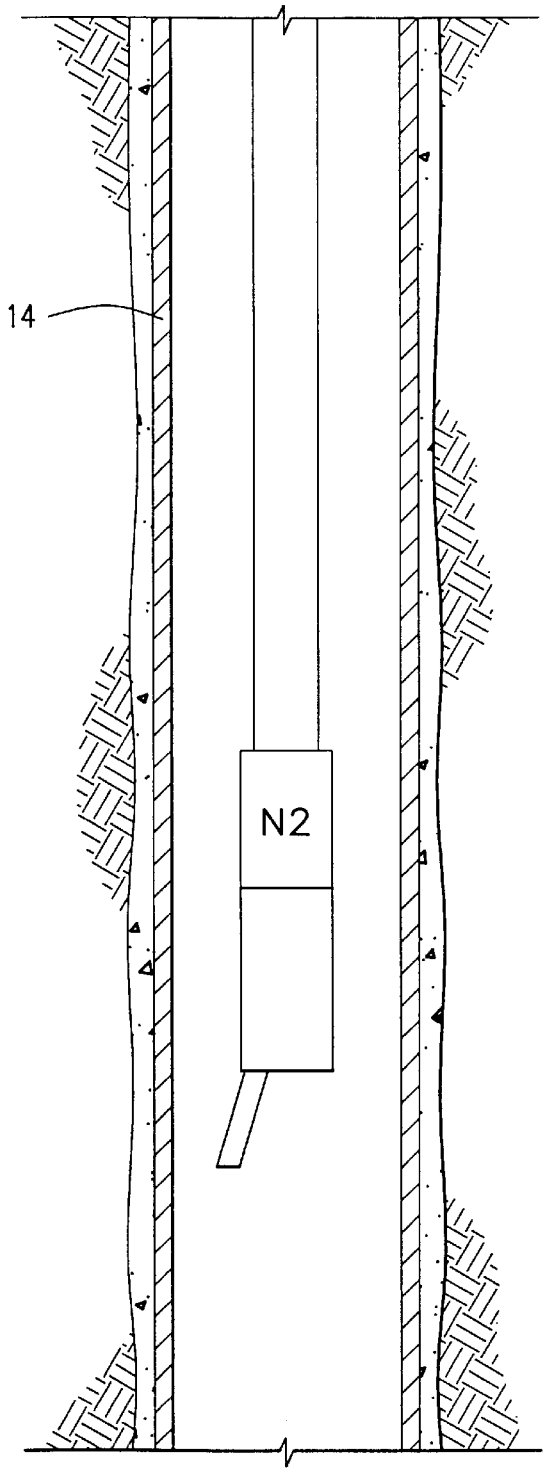
FIG. 3 illustrates one embodiment technique for supplying inert gas.

Referring to FIGS. 3–6, the inert gas, such as nitrogen, may be delivered to the desired location in the well bore in a number of ways. One method, shown generally in FIG. 3, is to use a separate tank in the tool. This is essentially the same as first embodiment 10 previously described.

Figure 4:
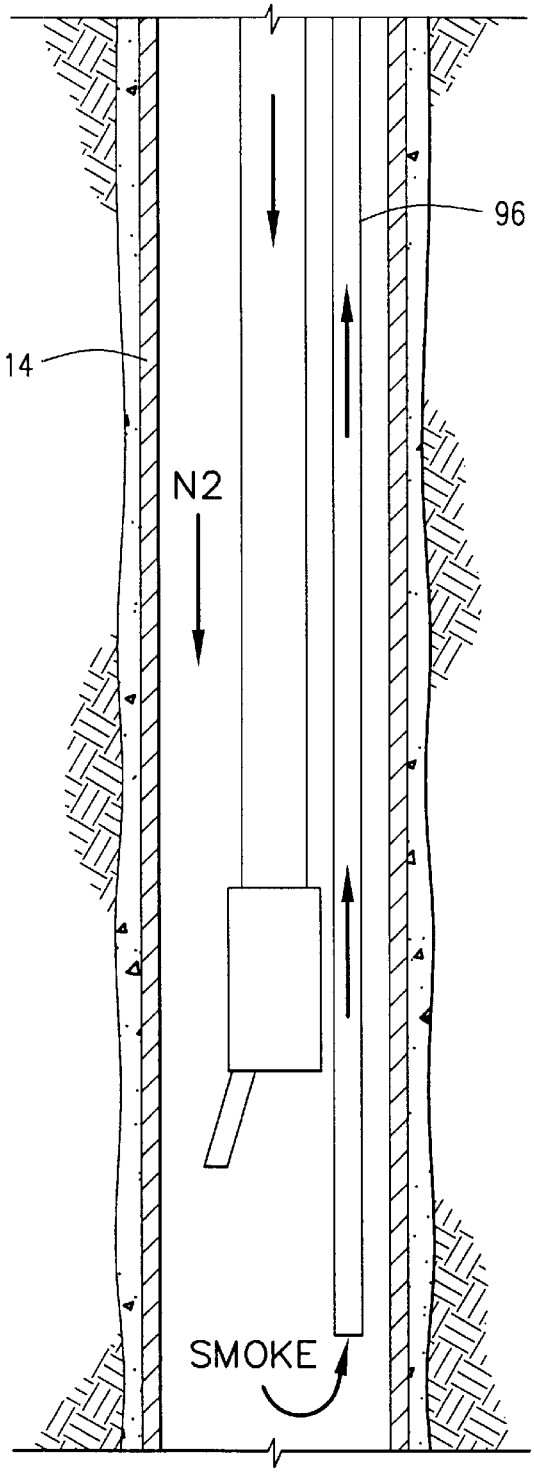
FIG. 4 shows an additional embodiment technique for supplying inert gas.

Another technique would be to pump the inert gas down well casing 14 around the tool as shown in FIG. 4. Smoke generated from combustion would be withdrawn from casing 14 by a vent tube 96.

Figure 5:
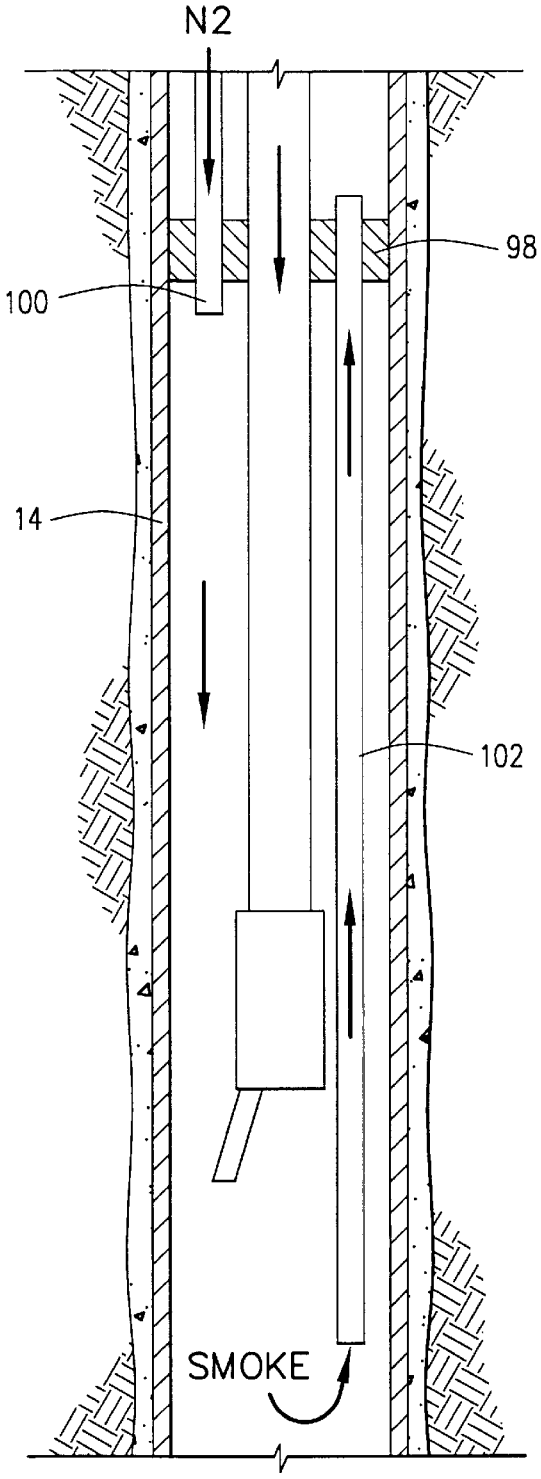
FIG. 5 presents a further embodiment technique for supplying inert gas.

A further technique is shown in FIG. 5. A sealing means, such as a packer 98, is used to seal between tool string 12 and casing 14. A supply tube 100 extends from the surface through packer 98 and is used to supply the inert gas to the desired area in casing 14 adjacent to the tool. Smoke from combustion is vented from that area to a location in casing 14 above packer 98 through a vent tube 102.

Figure 6:
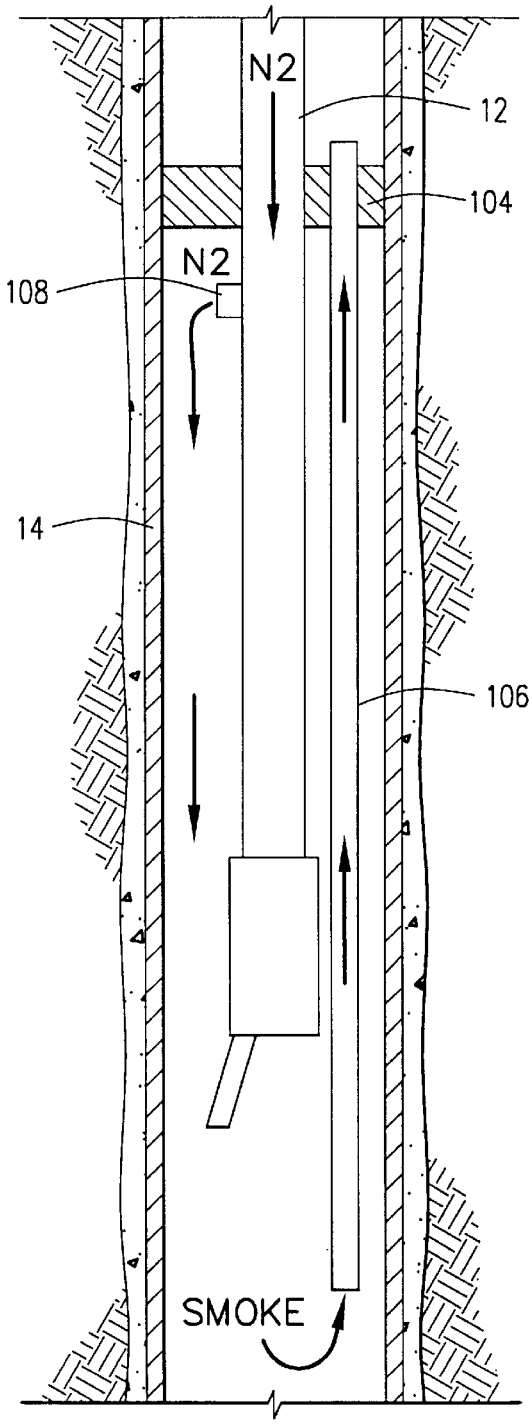
FIG. 6 illustrates still another embodiment technique for supplying inert gas.

Still another technique is illustrated in FIG. 6. In this version, a packer 104 is used to seal between tool string 12 and casing 14. A vent tube 106 extends through packer 104 and is used to vent smoke as previously described. The inert gas is pumped down through tool string 12 and discharged through a supply port 108 below packer 104.

Operation of the First Embodiment

Tool string 12 is made up with apparatus 10 at the lower end thereof and run into casing 14 of wellbore 16 such that the apparatus is generally near the desired area 68 in casing 12. Area 68 may be any kind of opening in casing 14. In the drawing, area 68 is illustrated as a damaged portion within casing 14 which leaves an exposed bare portion 70 of wellbore 14. However, it should be understood that apparatus 10 is not limited only to the repair of damaged areas in casing 14. Area 68 could also be an opening which is intended to be in the casing but which must be closed after certain well operations. Additionally, area 68 could be a gap between two adjacent sections of casing. Basically, the invention is intended to be used for closing or filling any type of opening in casing 14, and not just the particular ones listed herein.

Exact positioning of nozzle portion 44 of spray head 40 with respect to area 68 in casing 14 is accomplished by actuating drive portion 24 of steering sub 20 as desired. Light 66 illuminates the interior of casing 14, as previously mentioned, and camera 64 allows the operator to position nozzle portion 44 of spray head 40 as precisely as necessary.

Opening of oxygen mixing valve 50, fuel mixing valve 56 and powder mixing valve 60 allow the oxygen, fuel and metal powder to flow into spray head 40 and subsequently out nozzle portion 44. Oxygen meter 48 and fuel meter 54 allow for a proper combustible mixture of oxygen and fuel so that a metallized flame spray 72 is discharged from nozzle portion 44. For example, for kerosene, a preferred flow rate of oxygen would be approximately 280 standard cubic feet of oxygen per gallon of kerosene. This may vary depending upon well conditions and the size of nozzle portion 44. The control of flow of oxygen from oxygen tank 26 is important so that a proper combustion is obtained with the oxygen and fuel. An improper flow of oxygen can cause burn-up of the steel of casing 14 and thus destroy more of the casing rather than repair it or otherwise close it.

Flame spray 72 contains the metal powder therein which is directed into area 68 to gradually close or fill the opening. An advantage to a metal flame spray is that it may be discharged directly on exposed portion 70 of the wellbore. That is, the flame spray does not need to be directed to the metal forming casing 14 at all times. The metal will gradually build up and close area 68 and, of course, permanently adhere to the adjacent metal of casing 14.

As previously mentioned, the pressurized inert gas in inert gas tank 32 forces the metal powder in powder container 38 into spray head 40 so that it is mixed with the oxygen and fuel to form the appropriate flame spray. Another advantage of the inert gas is that it will also boost flame speed out of nozzle portion 44 of spray head 40 so that less time is necessary to fill area 68.

Another purpose of the inert gas is to reduce the combustion temperature of the fuel to prevent heat damage to casing 14. The inert gas also helps clear smoke caused by the combustion which improves the vision available through camera 64.

A tube 74 may be inserted in annulus 30 such that a lower end 76 of the tube is near nozzle portion 44. The pressure in tube 74 may be lowered in a manner known in the art to evacuate fumes of combustion from annulus 30 to improve vision through camera 64. The position of tube 74 in FIG. 1 is for illustrative purposes only. It will be understood by those skilled in the art, that the tube would not be positioned directly between flame spray 72 and exposed portion 70. Rather, it would preferably be to one side so that it is not damaged by the heat.

Figure 2:
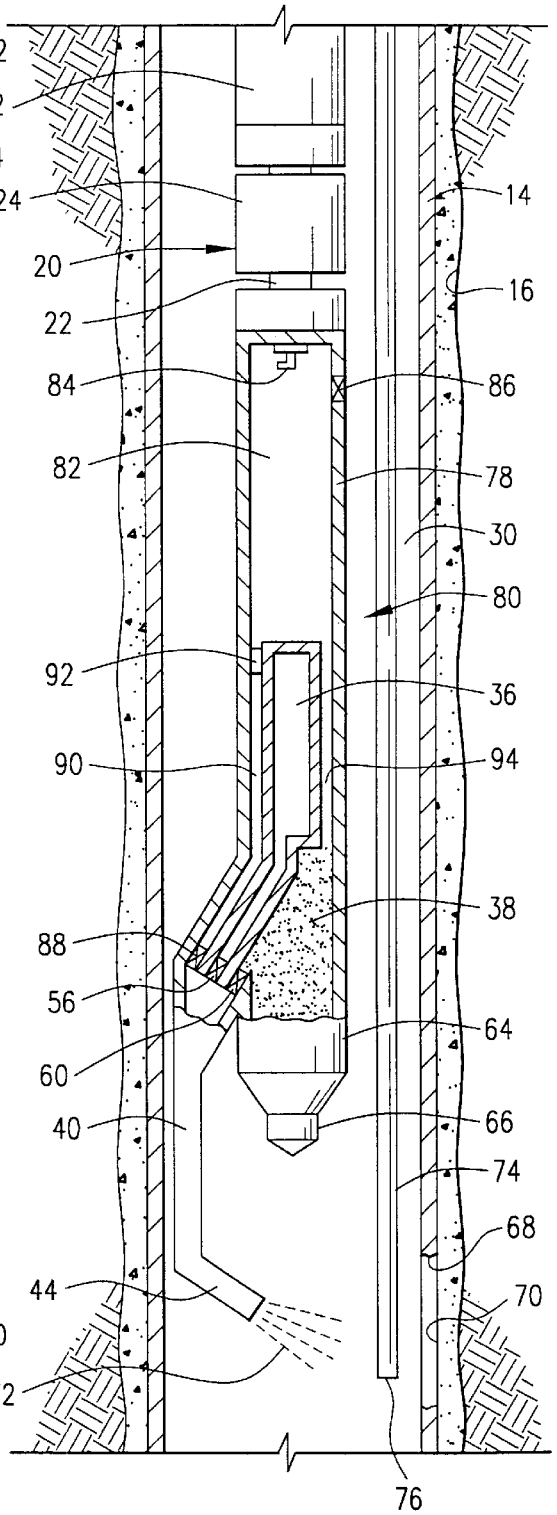
FIG. 2 shows an alternate embodiment of the flame spray welding tool.

Referring now to FIG. 2, a second embodiment of the apparatus of the present invention is shown and generally designated by the numeral 80. Like first embodiment 10, the second embodiment is connected to the lower end of a tool string 12 which is positioned in casing 14 of wellbore 16.

Second embodiment apparatus 80 is similar to first embodiment apparatus 10 except that the second embodiment does not include a separate oxygen tank 26 and inert gas tank 32. Rather, a single gas tank 82 is provided along with fuel tank 36 and powder container 38. Gas tank 82 has a sparking device 84, such as a spark plug, disposed therein.

Gas tank 82 is filled with a gas such as nitrous oxide ($N_2O$) which can be decomposed into oxygen and the inert gas nitrogen when heat is applied thereto from sparking device 84.

A gas equalizer 86 ensures that the pressure of the gas in gas tank 82 is maintained at a desired level with respect to the pressure in well annulus 30.

Housing 78 has a spray head 40 substantially identical to that previously described for first embodiment 10. A gas mixing valve 88 is included in spray head 40 along with the same fuel mixing valve and powder mixing valve previously described.

A first gas line 90 inner connects gas tank 82 with gas mixing valve 88 and may have a gas meter 92 disposed therein. A second gas line 94 inner connects gas tank 82 with powder container 38 so the pressure is applied to the powder to force it outwardly through powder mixing valve 60.

Operation of the Second Embodiment

Tool string 12 is made up with apparatus 80 at the lower end thereof and run into casing 14 of wellbore 16 such that the apparatus is generally near the desired area 68 in casing 12 in a manner substantially identical to first embodiment 10.

By applying electrical power to sparking device 84, heat is applied to the nitrous oxide in gas tank 82 to start decomposing the gas into its separate components of nitrogen and oxygen. The decomposition reaction creates additional heat which continues the reaction. The mixture of oxygen and nitrogen is discharged through gas mixing valve 88 where the oxygen combines with the fuel to create combustion. The rest of the operation is substantially the same as the first embodiment.

In still another embodiment, rather than having an inert gas stored separately in the tool as in first embodiment 10 or created by decomposing nitrous oxide as in the second embodiment, the inert gas may be totally eliminated from the tool itself and pumped down well annulus 30. In this event, another means must be provided to apply pressure to powder container 38, such as by using oxygen to force the powder out of the tool during operation. It will be seen that in all of these cases, the nitrogen is thus provided in the area around nozzle portion 44 so that the heat of combustion is dampened which reduces the combustion temperature so that heat damage does not occur to casing 14. Also, in any of these embodiments, the nitrogen may be used to clear the smoke caused by the combustion so that the view through camera 66 is improved.

In using the apparatus and method of the present invention, it is contemplated that about one-half pound per minute of metal may be deposited in the target area.

In addition to the flame spray embodiment shown and described, the invention could utilize any other means for depositing metal. For example, but not by way of limitation, a metallized plasma spray, welding, etc., could be used.

It will be seen, therefore, that the apparatus and method of the present invention are well adapted to carry out the ends and advantages mentioned, as well as those inherent therein. While a presently preferred embodiment of the apparatus and method have been described for the purposes of this disclosure, numerous changes in the arrangement and construction of parts in the apparatus and steps in the method may be made by those skilled in the art. All such changes are encompassed within the scope and spirit of the appended claims.

What is claimed is:

1. A method of closing an opening in a wellbore casing string comprising the step of filling the opening with metallic material while the casing is positioned in the wellbore, wherein said step of filling is performed by flame spraying said material into said opening.

2. The method of claim 1 further comprising the step of positioning a vacuum tube in the wellbore to evacuate smoke caused by combustion of the fuel and oxygen.

3. The method of claim wherein the opening is a gap formed at adjacent ends of a pair of casing sections in the casing string.

4. The method of claim 1 wherein the opening is a damaged area of the casing string.

5. The method of claim 1 wherein:

the flame spraying step comprises positioning a tool in the casing, the tool being on an end of a tool string and comprising:

a housing connected to the tool string;

an oxygen tank with oxygen therein disposed in said housing;

a fuel tank with fuel therein disposed in said housing;

a powder container having metal powder therein disposed in said housing; and a spray head attached to said housing and in communication with said oxygen tank, fuel tank and powder container such that a metallized flame resulting from mixing of the oxygen, fuel and metal powder is discharged from the spray head.

6. The method of claim 5 wherein the fuel is selected from the group consisting of liquefied petroleum gas, kerosene and acetylene.

7. The method of claim 5 wherein:

the tool further comprises an inert gas tank having a pressurized inert gas therein in communication with said powder container; and further comprising pushing the metal powder out of said powder container into said spray head with said pressurized inert gas.

8. The method of claim 7 wherein said inert gas is selected from the group consisting of argon and nitrogen.

9. The method of claim 5 further comprising the step of supplying an inert gas adjacent to said metallized flame.

10. The method of claim 9 wherein said inert gas is disposed in a tank in said housing.

11. The method of claim 9 wherein said inert gas is pumped down a casing annulus defined between the casing and said tool.

12. The method of claim 11 further comprising the step of venting smoke caused by the metallied flame from the casing.

13. The method of claim 12 wherein said step of venting comprises positioning a vent tube adjacent to said tool.

14. The method of claim 9 wherein said tool further comprises:

a packer adapted for sealingly engaging the casing; and a supply tube extending through said packer and providing communication between a supply of said inert gas and an area adjacent to said metallized flame.

15. The method of claim 14 wherein said tool further comprises a vent tube extending through said packer and adapted for venting smoke from said metallized flame.

16. The method of claim 9 wherein:

said tool further comprises a packer adapted for sealingly engaging the casing;

a port below said packer; and a passageway providing communication between said port and a supply of said inert gas.

17. The method of claim 16 wherein said tool further comprises a vent tube extending through said packer and adapted for venting smoke from said metallized flame.

18. The method of claim 9 wherein said inert gas is selected from the group consisting of argon and nitrogen.

19. The method of claim 1 wherein:

the flame spraying step comprises positioning a tool in the casing, the tool being on an end of a tool string and comprising:

a housing connected to the tool string;

a gas tank with nitrous oxide therein disposed in said housing;

a sparking device disposed in said gas tank whereby a spark may be applied to the nitrous oxide to cause a decomposition reaction, separating the nitrous oxide into oxygen and nitrogen components thereof;

a fuel tank with fuel therein disposed in said housing;

a powder container having metal powder disposed in said housing; and a spray head attached to said housing and in communication with said gas tank, fuel tank and powder container such that a metallized flame resulting from mixing of the oxygen, fuel and metal powder is discharged from the spray head.

20. The method of claim 19 wherein the fuel is selected from the group consisting of liquefied petroleum gas, kerosene and acetylene.

21. The method of claim 1 wherein the filling step comprises longitudinally moving and rotating said housing within the casing such that said spray head is directed toward the opening in the casing.

22. The method of claim 21 wherein the step of longitudinally moving and rotating comprises actuating a steering sub disposed between said housing and tool string.

23. The method of claim 1 wherein the filling step is performed by plasma spraying said material into said opening.

24. The method of claim 1 wherein the filling step comprises welding said material in said opening.

25. The method of claim 1 further comprising providing nitrogen in the wellbore to dampen the temperature of combustion.

26. The method of claim 25 wherein the step of providing nitrogen comprises pumping nitrogen down the wellbore.

27. The method of claim 25 wherein the step of providing nitrogen comprises decomposing nitrous oxide into oxygen and nitrogen components thereof.

28. An apparatus for filling an opening in well casing from the inside of the well casing, said apparatus comprising:

an oxygen supply;

a fuel tank;

a metal supply; and metal depositing means in communication with said oxygen supply, fuel tank and metal supply such that heat is generated by the mixture of oxygen and fuel, and heated metal is deposited in the opening and adhered to the well casing.

29. The apparatus of claim 28 further comprising a steering sub adapted for connection to a tool string whereby said metal depositing means may be rotated and reciprocated within the casing to guide the metal depositing means to a desired area in the casing.

30. The apparatus of claim 28 wherein said fuel tank is filled with a fuel from the group consisting of liquefied petroleum gas, kerosene and acetylene.

31. The apparatus of claim 30 wherein said fuel is propane.

32. The apparatus of claim 30 wherein:

said fuel is kerosene; and further comprising a meter for metering flow of oxygen from said oxygen supply and kerosene from said fuel tank.

33. The apparatus of claim 32 wherein the flow of oxygen is less than about 280 standard cubic feet per gallon of kerosene.

34. The apparatus of claim 32 further comprising:

a camera; and a light disposed adjacent to said camera for lighting an area toward which said camera is directed;

whereby, an operator may use said camera to guide said metal depositing means to a desired area in said casing.

35. The apparatus of claim 28 wherein:

said metal supply is a quantity of metal powder; and said metal depositing means comprises:

a powder container in which said metal powder is disposed; and a spray head in communication with said oxygen supply, fuel tank and powder container such that said mixture is a mixture of oxygen, fuel and metal powder which is discharged as a flame spray from said spray head.

36. The apparatus of claim 35 further comprising an inert gas supply adapted for supplying an inert gas adjacent to said metal depositing means to dampen said heat.

37. The apparatus of claim 36 wherein said inert gas may be flowed into said mixture to boost flame speed of the flame spray discharged from said spray head.

38. The apparatus of claim 36 wherein said inert gas supply is in communication with said powder container.

39. The apparatus of claim 38 wherein said inert gas is selected from the group consisting of nitrogen and argon.

40. The apparatus of claim 36 wherein said inert gas supply inert gas is pressurized such that it pushes the metal powder into said spray head.

41. The apparatus of claim 36 further comprising a housing and wherein:

said oxygen supply, said fuel tank and said metal supply are disposed in said housing; and said inert gas supply is an inert gas tank disposed in said housing.

42. The apparatus of claim 36 wherein said inert gas supply is located at the surface of the well such that the inert gas may be pumped down through the well casing.

43. The apparatus of claim 42 further comprising a vent tube for venting smoke created by said heat.

44. The apparatus of claim 36 wherein said inert gas supply is located at the surface of the well, and further comprising:

a packer adapted for sealing engagement with the well casing; and a supply tube extending through said packer and in communication with said inert gas supply.

45. The apparatus of claim 44 further comprising a vent tube disposed through said packer for venting smoke created by said heat.

46. The apparatus of claim 36 further comprising a packer adapted for sealingly engaging the casing;

a port below said packer; and a passageway providing communication between said port and a supply of said inert gas.

47. The apparatus of claim 46 further comprising a vent tube disposed through said packer for venting smoke created by said heat.

48. An apparatus for spraying metal into a desired area of a well casing from the inside of the well casing, said apparatus comprising:

a steering sub adapted for connection to a tool string;

a housing attached to said steering sub such that said steering sub provides movement of said housing with respect to the tool string;

an oxygen tank in said housing, said oxygen tank having a quantity of pressurized oxygen therein;

an inert gas supply;

a fuel tank in said housing, said fuel tank having a quantity of fuel therein;

a powder container in said housing, said powder container having a quantity of metal powder therein and being in communication with said inert gas tank such that said pressurized inert gas tends to push said metal powder out of said powder container; and a spray head connected to said housing and in communication with said oxygen tank, fuel tank and powder container such that fuel, oxygen, inert gas and metal powder are mixed in said spray head and discharged therefrom as a metallic flame spray whereby metal may be deposited at the desired area in the casing.

49. The apparatus of claim 48 wherein said inert gas supply is an inert gas tank disposed in said housing, said inert gas tank having a quantity of pressurized inert gas therein.

50. The apparatus of claim 48 wherein said fuel is selected from the group consisting of liquefied petroleum gas, kerosene and acetylene.

51. The apparatus of claim 50 wherein said fuel is propane.

52. The apparatus of claim 50 wherein:

said fuel is kerosene; and further comprising a meter for metering flow of said oxygen from said oxygen tank and kerosene from said fuel tank.

53. The apparatus of claim 52 wherein said flow of said oxygen is less than about 280 standard cubic feet per gallon of kerosene.

54. The apparatus of claim 48 wherein said inert gas is selected from the group consisting of nitrogen and argon.

55. The apparatus of claim 48 further comprising:

a camera disposed below said powder container and adapted for taking a photographic image of the inside of the casing; and a light disposed adjacent to said camera for lighting the inside of the casing when said camera is directed thereto;

whereby, an operator may use said camera to view movement of said spray head and direct said flame spray discharged from said spray head to the desired area in the casing.

56. The apparatus of claim 48 wherein said steering sub is adapted for rotating and longitudinally moving said spray head within the casing so that said spray head may be directed to the desired area in the casing.

57. The apparatus of claim 48 further comprising a meter for metering flow of said oxygen and fuel to said spray head.

58. The apparatus of claim 48 wherein said inert gas supply is at the surface of the well such that the inert gas may be pumped down the well casing.

59. The apparatus of claim 58 further comprising a vent tube for venting smoke created by said spray.

60. The apparatus of claim 58 further comprising:

a packer for sealingly engaging the well casing; and a supply tube disposed through said packer and in communication with said inert gas supply.

61. The apparatus of claim 60 further comprising a vent tube extending through said packer for venting smoke created by said spray.

62. The apparatus of claim 58 further comprising a packer adapted for sealingly engaging the casing;

a port below said packer; and a passageway providing communication between said port and a supply of said inert gas.

63. The apparatus of claim 62 further comprising a vent tube extending through said packer for venting smoke created by said spray.

64. An apparatus for spraying metal into a desired area of a well casing from the inside of the well casing, said apparatus comprising:

a steering sub adapted for connection to a tool string;

a housing attached to said steering sub such that said steering sub provides movement of said housing with respect to the tool string;

a gas tank in said housing, said gas tank having a quantity of pressurized nitrous oxide therein;

a sparking device positioned in said gas tank such that application of electrical power to said sparking device applies heat to the nitrous oxide in said gas tank and thereby initiates a decomposition reaction so that the nitrous oxide is separated into oxygen and nitrogen components thereof;

a fuel tank in said housing, said fuel tank having a quantity of fuel therein;

a powder container in said housing, said powder container having a quantity of metal powder therein; and a spray head connected to said housing and in communication with said gas tank, fuel tank and powder container such that fuel, oxygen, nitrogen and metal powder are mixed in said spray head and discharged therefrom as a metallic flame spray whereby metal may be deposited at the desired area in the casing.

65. The apparatus of claim 64 wherein said fuel is selected from the group consisting of liquefied petroleum gas and kerosene.

66. The apparatus of claim 64 further comprising:

a camera disposed below said powder container and adapted for taking a photographic image of the inside of the casing; and a light disposed adjacent to said camera for lighting the inside of the casing when said camera is directed thereto;

whereby, an operator may use said camera to view movement of said spray head and direct said flame spray discharge from said spray head to the desired area in the casing.

67. The apparatus of claim 64 wherein said steering sub is adapted for rotating and longitudinally moving said spray head within the casing so that said spray head may be directed to the desired area in the casing.

* * * * *